US010262849B2

(12) United States Patent
Monroe et al.

(10) Patent No.: US 10,262,849 B2
(45) **Date of Patent: *Apr. 16, 2019**

(54) ACTIVE STABILIZATION OF ION TRAP RADIOFREQUENCY POTENTIALS

(71) Applicant: University of Maryland, College Park, MD (US)

(72) Inventors: Christopher Monroe, Ellicott City, MD (US); Kale Johnson, Milford, CT (US); Jaime David Wong-Campos, Hyattsville, MD (US)

(73) Assignee: University of Maryland, College Park, MD (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/997,107

(22) Filed: Jun. 4, 2018

(65) Prior Publication Data

US 2018/0286648 A1 Oct. 4, 2018

Related U.S. Application Data

(63) Continuation of application No. 15/389,982, filed on Dec. 23, 2016, now Pat. No. 9,991,105.
(Continued)

(51) Int. Cl.
*H01J 49/00* (2006.01)
*H01J 49/42* (2006.01)
*H01J 49/02* (2006.01)

(52) U.S. Cl.
CPC ..... *H01J 49/0027* (2013.01); *H01J 49/022* (2013.01); *H01J 49/422* (2013.01)

(58) Field of Classification Search
CPC ..... H01J 49/00; H01J 49/02; H01J 49/022; H01J 49/062; H01J 49/063; H01J 49/422
(Continued)

(56) References Cited

U.S. PATENT DOCUMENTS 5,043,576 A * 8/1991 Broadhurst ..... A61B 5/0205 250/281
5,401,973 A * 3/1995 McKeown ..... H05H 1/0006 250/396 R
(Continued)

FOREIGN PATENT DOCUMENTS

EP 2015345 A2 1/2009
WO 93/08590 A1 4/1993

OTHER PUBLICATIONS

"International Search Report & Written Opinion", International Patent Application No. PCT/US2016/068535, Date Completed Mar. 2, 2017, 10 pp.

*Primary Examiner* — Jason L McCormack
(74) *Attorney, Agent, or Firm* — Kaplan Breyer Schwarz, LLP

(57) ABSTRACT

Disclosed are improved methods and structures for actively stabilizing the oscillation frequency of a trapped ion by noninvasively sampling and rectifying the high voltage RF potential at circuit locations between a step-up transformer and a vacuum feedthrough leading to the ion trap electrodes. We use this sampled/rectified signal in a feedback loop to regulate the RF input amplitude to the circuit. By employing techniques and structures according to the present disclosure we are advantageously able to stabilize a 1 MHz trapped ion oscillation frequency to <10 Hz after 200 s of integration, representing a 34 dB reduction in the level of trap frequency noise and drift, over a locking bandwidth of up to 30 kHz.

8 Claims, 12 Drawing Sheets

Related U.S. Application Data

(60) Provisional application No. 62/387,187, filed on Dec. 23, 2015.

(58) Field of Classification Search
USPC ..... 250/281, 282, 288
See application file for complete search history.

(56) References Cited

U.S. PATENT DOCUMENTS

| | | | | |
|---|---|---|---|---|
| 5,966,425 | A * | 10/1999 | Beland | H02M 7/1557 378/108 |
| 7,161,142 | B1 * | 1/2007 | Patterson | H01J 49/0022 250/281 |
| 9,991,105 | B2 * | 6/2018 | Monroe | H01J 49/0027 |
| 2005/0051720 | A1 | 3/2005 | Knecht et al. | |
| 2008/0067354 | A1 * | 3/2008 | Gabeler | H01J 49/022 250/288 |
| 2009/0294657 | A1 * | 12/2009 | Rafferty | H01J 49/022 250/283 |
| 2011/0208206 | A1 * | 8/2011 | Diamant | A61B 17/2202 606/128 |

* cited by examiner

ACTIVE STABILIZATION OF ION TRAP RADIOFREQUENCY POTENTIALS

CROSS REFERENCE TO RELATED APPLICATION

This application is a continuation of and claims any benefit of U.S. patent application Ser. No. 15/389,982 filed 23, Dec. 2016, which in turn claimed any benefit of U.S. Provisional Patent Application Ser. No. 62/387,187 filed 23, Dec. 2015, each of which is incorporated by reference as if set forth at length herein.

US GOVERNMENT RIGHTS

This invention was made with Government support under Contract PHY0822671 awarded by the NSF. The Government has certain rights in the invention.

TECHNICAL FIELD

This disclosure relates generally to the confinement of ions in a radiofrequency (RF) field in more particularly to the active stabilization of ion trap radiofrequency potentials.

BACKGROUND

As will be readily appreciated by those skilled in the art, charged particles are oftentimes controlled with radiofrequency electrical potentials whose field gradients provide time-averaged forces useful for a variety of applications including quadrupole mass filters, ion mass spectrometers and RF ion traps. These RF potentials—typically hundreds or thousands of volts at frequencies ranging from 1 kHz to 100 MHz—drive high impedance loads in vacuum and may be generated with RF amplifiers and resonant step-up transformers such as quarter-wave or helical resonators. As is further known by those skilled in the art, such circuitry is susceptible to fluctuations in amplifier gain, mechanical vibrations and temperature variations. Ion traps are particularly sensitive to these fluctuations as the RF potential determines the harmonic oscillation frequency of any trapped ions. Of course, stable ion trap frequencies are critical in applications such as quantum information processing—among others—including ion trap mass spectrometers, multipole mass spectrometers which may employ a variety of ion trap geometries including—but not limited to—quadrupole trap, linear trap, surface ion trap, hexapole and higher-order RF traps.

Actively stabilizing RF ion trap potentials requires the faithful sampling of RF potential. As will be readily understood by those skilled in the art, probing RF potential signals directly at electrodes is operationally difficult in a vacuum environment and may undesirably load the circuits or spoil resonator quality factor.

SUMMARY

The above problems are solved and an advance is made in the art according to aspects of the present disclosure directed to methods and structures for the active stabilization of ion trap radiofrequency potentials. The methods—according to the present disclosure—actively stabilize the oscillation frequency of a trapped ion by noninvasively sampling and rectifying high voltage RF potential at a circuit location between a step-up transformer and vacuum feedthrough leading to ion trap electrodes. The sampled/rectified signal is used in a feedback loop to regulate RF input amplitude to the circuit. Advantageously, and in sharp contrast to known prior art methods, the methods according to the present disclosure have demonstratively stabilized a 1 MHz trapped ion oscillation frequency to <10 Hz after 200 s of integration—representing a 34 dB reduction in the level of trap frequency noise and drift, over a locking bandwidth of up to 30 kHZ.

This SUMMARY is provided to briefly identify some aspect(s) of the present disclosure that are further described below in the DESCRIPTION. This SUMMARY is not intended to identify key or essential features of the present disclosure nor is it intended to limit the scope of any claims.

The term "aspect" is to be read as "at least one aspect". The aspects described above and other aspects of the present disclosure are illustrated by way of example(s) and not limited in the accompanying drawing.

BRIEF DESCRIPTION OF THE DRAWING

A more complete understanding of the present disclosure may be realized by reference to the accompanying drawing in which:

FIGS. 2(A) and 2(B) show schematics of an ion trap RF drive with active stabilization of the ion oscillation $\omega$ according to an aspect of the present disclosure in which: FIG. 2(A) illustrates stabilization of the ratio of RF potential amplitude to frequency $V_0/\Omega$ (lower section) using a digital divider (ADC: analog-to-digital converter and DAC: digital-to-analog converter), with a separate feedback loop (upper right section) that locks the RF drive frequency $\Omega$ to the resonant frequency of the step-up transformer; and FIG. 2(B) illustrates stabilization of the RF potential amplitude $V_0$ only, with fixed RF drive frequency;

FIGS. 4(A) and 4(B) show schematic illustrations according to aspects of the present disclosure in which: FIG. 4(A) shows a schematic circuit diagram depicting components of a pick-off voltage divider and temperature-compensating rectifier; and FIG. 4(B) shows connectorized housing and mounted rectifier circuits;

DETAILED DESCRIPTION

Figure 1:
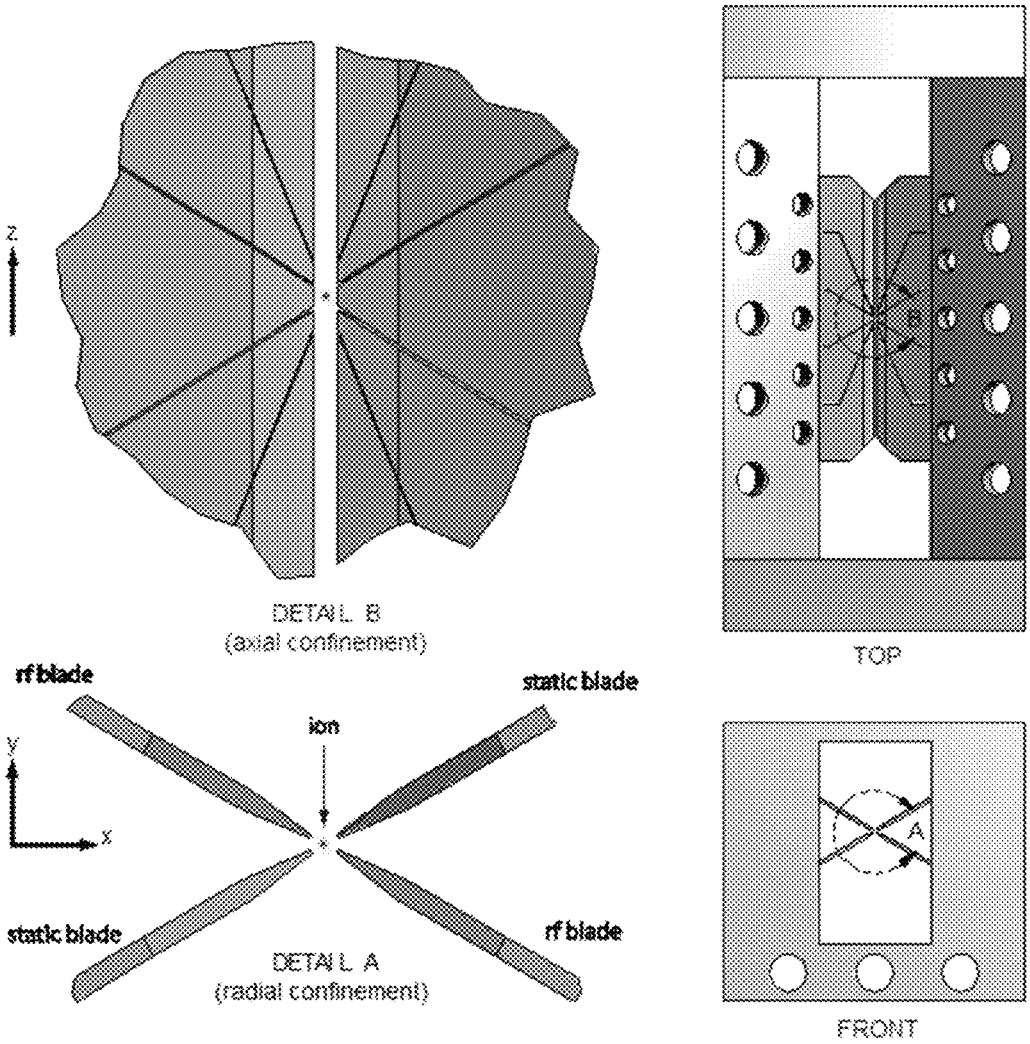
FIG. 1 shows a schematic diagram depicting an illustrative linear Paul trap having four gold-plated blade electrodes held in place by an insulating mount according to an aspect of the present disclosure.

The following merely illustrates the principles of the disclosure. It will thus be appreciated that those skilled in the art will be able to devise various arrangements which, although not explicitly described or shown herein, embody the principles of the disclosure and are included within its spirit and scope. More particularly, while numerous specific details are set forth, it is understood that embodiments of the disclosure may be practiced without these specific details and in other instances, well-known circuits, structures and techniques have not been shown in order not to obscure the understanding of this disclosure.

Furthermore, all examples and conditional language recited herein are principally intended expressly to be only for pedagogical purposes to aid the reader in understanding the principles of the disclosure and the concepts contributed by the inventor(s) to furthering the art, and are to be construed as being without limitation to such specifically recited examples and conditions.

Moreover, all statements herein reciting principles, aspects, and embodiments of the disclosure, as well as specific examples thereof, are intended to encompass both structural and functional equivalents thereof. Additionally, it is intended that such equivalents include both currently-known equivalents as well as equivalents developed in the future, i.e., any elements developed that perform the same function, regardless of structure.

Thus, for example, it will be appreciated by those skilled in the art that the diagrams herein represent conceptual views of illustrative structures embodying the principles of the disclosure.

In addition, it will be appreciated by those skilled in art that any flow charts, flow diagrams, state transition diagrams, pseudocode, and the like represent various processes which may be substantially represented in computer readable medium and so executed by a computer or processor, whether or not such computer or processor is explicitly shown.

In the claims hereof any element expressed as a means for performing a specified function is intended to encompass any way of performing that function including, for example, a) a combination of circuit elements which performs that function or b) software in any form, including, therefore, firmware, microcode or the like, combined with appropriate circuitry for executing that software to perform the function. The invention as defined by such claims resides in the fact that the functionalities provided by the various recited means are combined and brought together in the manner which the claims call for. Applicant thus regards any means which can provide those functionalities as equivalent as those shown herein. Finally, and unless otherwise explicitly specified herein, the drawings are not drawn to scale.

By way of some additional background, we begin by again noting that charged particles are often controlled with radiofrequency (RF) electrical potentials, whose field gradients provide time-averaged (ponderomotive) forces that form the basis for applications such as quadrupole mass filters, ion mass spectrometers, and RF (Paul) ion traps (See, e.g., H. Dehmelt, Rev. Mod. Phys., 62, 525 (1990); W. Paul, Rev. Mod. Phys., 62, 531 (1990)).

These RF electrical potentials—typically hundreds or thousands of volts at frequencies ranging from 1 kHz to 100 MHz—are used to drive high impedance loads in a vacuum and may be generated with circuitry including RF amplifiers and resonant step-up transformers such as quarter-wave or helical resonators (See, e.g., J. D. Siverns, L. R. Simkins, S. Weidt, and W. K. Hensinger, Appl. Phys. B, 107, 921 (2012)).

As is known and understood however, such circuitry is susceptible to fluctuations in amplifier gain, mechanical vibrations of the transformer, and temperature drifts in the system. Significantly for our purposes, ion traps are particularly sensitive to these fluctuations, because the RF potential determines the harmonic oscillation frequency of trapped ions. As will be readily understood and appreciated by those skilled in the art, stable trap frequencies are of critical importance in applications ranging from quantum information processing (See, e.g., D. Wineland and R. Blatt, Nature 453, 1008 (2008); C. Monroe and J. Kim, Science 339, 1164 (2013)) and quantum simulation (See, e.g., P. Richerme, Z. X. Gong, A. Lee, C. Senko, J. Smith, M. Foss-Feig, S. Michalakis, A. V. Gorshkov, and C. Monroe, Nature 511, 198 (2014); P. Jurcevic, B. P. Lanyon, P. Hauke, C. Jempel, P. Zoller, R. Blatt, and C. F. Roos, Nature 511, 202 (2014)), to the preparation of quantum states of atomic motion (See, e.g., D. Leibfried, R. Blatt, C. Monroe, and D. Wineland, Rev. Mod. Phys. 75, 281 (2003)), atom interferometry (See, e.g., K. G. Johnson, B. Neyenhuis, J. Mizrahi, J. D. Wong-Campos, and C. Monroe, Phys. Rev. Lett 115, 213001 (2015)), and quantum-limited metrology (See, e.g., C. W. Chou, D. B. Hume, J. C. J. Koelemeij, D. J. Wineland, and T. Rosenband, Phys. Rev. Lett. 104, 070802 (2010)).

As will be further appreciated and understood by those skilled in the art, actively stabilizing RF ion trap potentials requires faithful—and difficult—sampling of the RF potential. More particularly, probing a signal directly at the electrodes is difficult in a vacuum environment and can load the circuit or otherwise spoil the resonator quality factor. On the other hand, sampling the potential too far upstream is not necessarily accurate, owing—in part—to downstream inductance and capacitance.

According to the present disclosure, we actively stabilize the oscillation frequency of a trapped ion by noninvasively sampling and rectifying the high voltage RF potential between a step-up transformer and a vacuum feedthrough leading to the ion trap electrodes. We use this sampled/rectified signal in a feedback loop to regulate the RF input amplitude to the circuit. As we shall show by employing such techniques according to the present disclosure we are advantageously able to stabilize a 1 MHz trapped ion oscillation frequency to <10 Hz after 200 s of integration, representing a 34 dB reduction in the level of trap frequency noise and drift, over a locking bandwidth of up to 30 kHz.

As will be appreciated and according to the present disclosure, an ion is trapped in a linear RF trap, configured such that a two-dimensional RF quadrupole electric field is superposed with a static quadrupole electric field to provide confinement along the longitudinal direction (See, e.g., M. G. Raizen, J. M. Gilligan, J. C. Bergquist, W. M. Itano, and D. J. Wineland, Phys. Rev. A 45, 6493(1992)).

Notably, longitudinal confinement is typically set much weaker than transverse confinement, so that a crystal of laser-cooled ions can reside along the x=y=0 RF field null without undergoing effects of RF-induced micromotion. The transverse confinement, dictated by the RF fields, is used for many applications because motion along these directions is at higher frequency and the normal mode spectrum for a chain of ions can be tuned (See, e.g., S. L. Zhu, C. Monroe, and L. M. Duan, Phys. Rev. Lett 97, 050505 (2006)). As is known, linear ion traps exist in a variety of topologically equivalent electrode configurations, including those having electrodes all positioned in a single plane for ease in lithographic fabrication (See, e.g., J. Chiaverini, R. B. Blakestad, J. Britton, J. D. Host, C. Langer, D. Liebfried, R. Ozeri, and D. J. Wineland, Quantum Inf. Comput. 5, 419 (2005)).

FIG. 1 is a schematic illustrating a linear Paul trap having four gold-plated blade electrodes that are held in place by an insulating mount. An ion is confined in between the electrodes through a combination of RF and static potentials applied to the electrodes. Each blade is split longitudinally into 5 segments that are electrically isolated on the static blades and electrically connected on the RF blades. The transverse distance from the ion axis to each electrode is R=200 μm, and the length of the central longitudinal segments is 400 μm.

As may be observed in FIG. 1, the linear trap has four gold-plated ceramic "blade" electrodes with their edges arranged parallel to the longitudinal (z) axis of the trap as shown in FIG. 1. Two opposite blades are driven with an RF potential with respect to the other two static blades, creating the transverse (x-y) quadrupole confinement potential. Appropriate static potentials applied to the longitudinally-segmented static blades serve to confine the ions along the z-axis. The RF electric quadrupole potential near the center of the trap $$V(x, y) = \frac{\mu V_0}{2R^2}(x^2 - y^2)\cos \Omega t$$

is set by the RF amplitude on the trap electrode $V_0$, the distance from the trap center to the electrodes R, the RF drive frequency Ω, and a dimensionless geometric efficiency factor μ: 0.3 for the geometry of FIG. 1.

A particle with charge e and mass m inside the trap experiences a resulting ponderomotive "psuedopotential"

$$U_{pon} = \frac{e^2}{4m\Omega^2}|\nabla V|^2 = \frac{e^2\mu^2 V_0^2}{4m\Omega^2 R^4}(x^2 + y^2),$$

with harmonic oscillation frequency described by, $$\omega = \frac{e\mu V_0}{\sqrt{2}\, m\Omega R^2}. \quad (1)$$

This expression is valid under the pseudopotential approximation where ω=Ω (See, e.g., J. Chiaverini, R. B. Blakestead, J. Britton, J. D. Jost, C. Langer, D. Liebfried, R. Ozeri, and D. J. Wineland, Quantum Inf. Comput. 5, 419 (2005)), and we do not consider the residual transverse forces from the static potentials, because they are relatively small and stable.

One approach to stabilize the ion oscillation frequency is to control the ratio $V_0/\Omega$, which is important in cases where the RF drive frequency is itself dithered to maintain resonance with the step-up transformer. This is necessary when the transformer resonance drifts, may be due to mechanical or temperature fluctuations, by a significant amount of its linewidth.

Figure 2A:
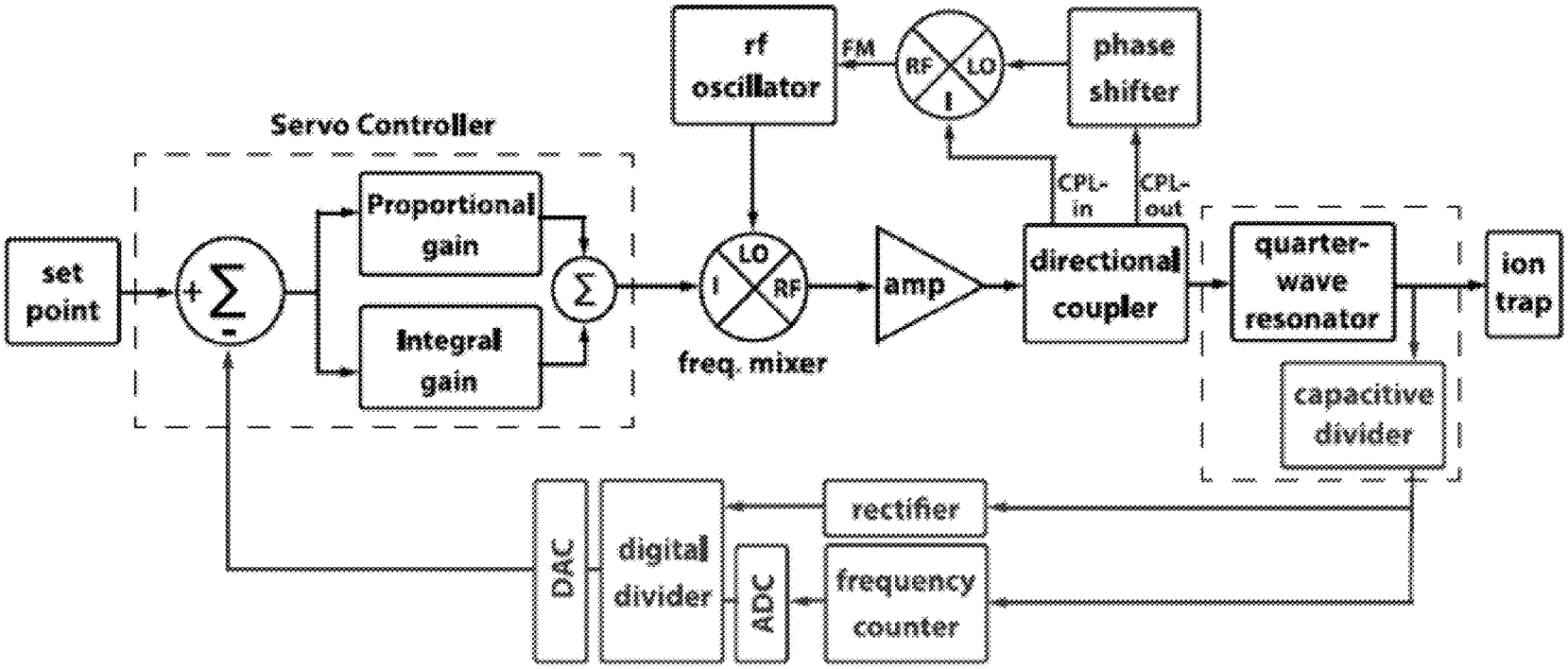

Such a feedback system is shown schematically in FIG. 2(A). As may be observed from FIG. 2(A), one feedback loop (upper right section) locks the RF drive frequency (tuned using frequency modulation—FM) to the step-up transformer resonance by deriving a zero crossing in the error signal from a phase shift across resonance of the reflected signal. Operationally, this is effected using a directional coupler to sample drive and reflected signals and comparing any difference in phase using a frequency mixer.

Figure 2B:
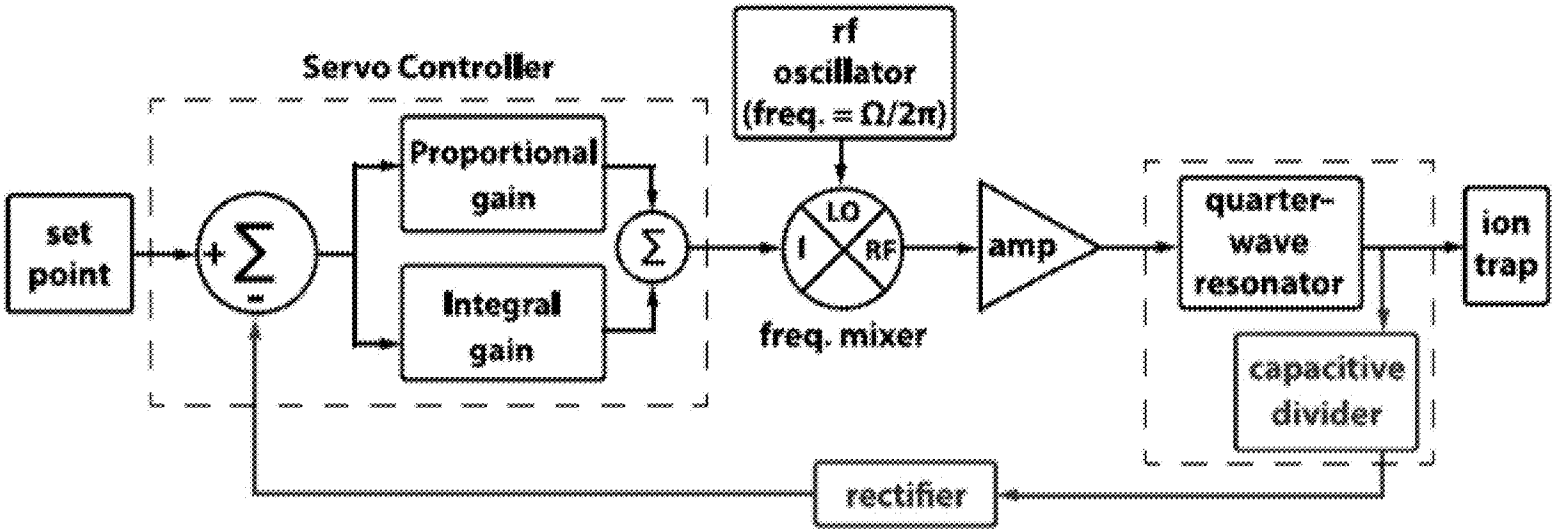

With further reference to FIG. 2(A), a second feedback loop (lower section) stabilizes the ratio $V_0/\Omega$) using a digital divider. One difficulty with this approach is the required performance of the digital divider circuit, which must have a precision as good as the desired stability, and be fast enough to stabilize the system at the desired bandwidth. Moreover, higher order corrections to the trap frequency beyond the psuedopotental expression of Eq. 1 depend on terms that do not scale simply as the ratio $V_0/\Omega$). Therefore, we instead stabilize the RF potential amplitude $V_0$ alone, and use a fixed frequency RF oscillator and passively stable transformer circuit, as depicted in FIG. 2(B).

As will be appreciated and according to the present disclosure, we stabilize RF confinement potential by sampling a high voltage RF signal supplying an ion trap electrode and feeding it back to a frequency mixer that controls upstream RF oscillator amplitude. As shown in the schematic of FIG. 2(B), an RF signal at Ω/2π=17 MHz and −8 dBm is produced by an RF oscillator (SRS DS345) and sent through a LO port of a level 3 frequency mixer (Mini-Circuits ZX05-1L-S), having a conversion loss of 5.6 dB. The RF port of the mixer is connected to an RF amplifier (Mini-Circuits TVA-R5-13) having a self-contained cooling system, providing a gain of 38 dB. The amplifier output signal is fed into an antenna (not specifically shown in FIG. 2(B)) that inductively couples to a 17 MHz quarter-wave helical resonator and provides impedance matching between the RF source and the circuit formed by the resonator and ion trap electrode capacitance. The antenna, resonator, and equivalent ion trap capacitance $C_{trap}$ are shown in FIG. 3, and exhibit an unloaded quality factor $Q_U$: 600.

Figure 3:
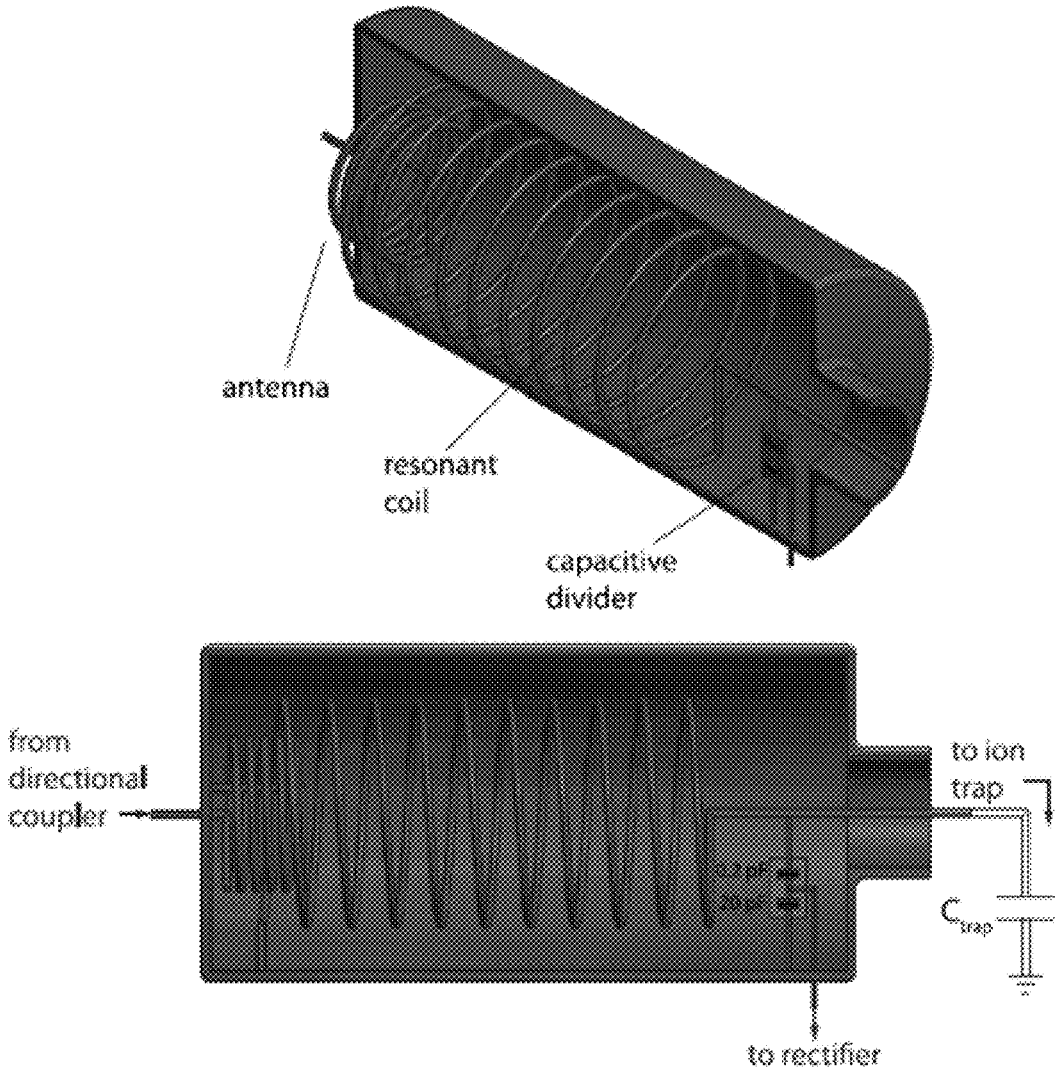
FIG. 3 shows a schematic illustrating a helical quarter-wave resonator (transformer) with a 1:100 capacitive divider (0.2 pF and 20 pF) mounted inside of the resonator near the high voltage side according to an aspect of the present disclosure.

FIG. 3 illustrates a helical quarter-wave resonator (transformer) having a 1:100 capacitive divider (0.2 pF and 20 pF) mounted inside of the resonator near the high voltage side. The divider samples $V_0$ for feedback. A rigid wire is soldered from the output portion of a copper resonator coil to a copper-clad epoxy circuit board including dividing capacitors. The resonator drives the capacitance $C_{trap}$ of the vacuum feedthrough and ion trap electrodes.

Operationally, the capacitive divider samples roughly 1% of the helical resonator output, using $C_1$=0.2 pF and $C_2$=20 pF ceramic capacitors (Vishay's QUAD HIFREQ Series) exhibiting temperature coefficients of 0±30 ppm/° C. With $C_1=C_{trap}$ and residual inductance between the divider and the trap electrodes much smaller than the resonator inductance itself, the divider faithfully samples the RF potential within a few centimeters of the trap electrodes and does not significantly load the trap/transformer circuit. Notably, the capacitors are shown as surface-mounted to a milled copper-clad epoxy circuit board and installed inside the shielded resonator cavity, as shown illustratively in FIG. 3.

Figure 4A:
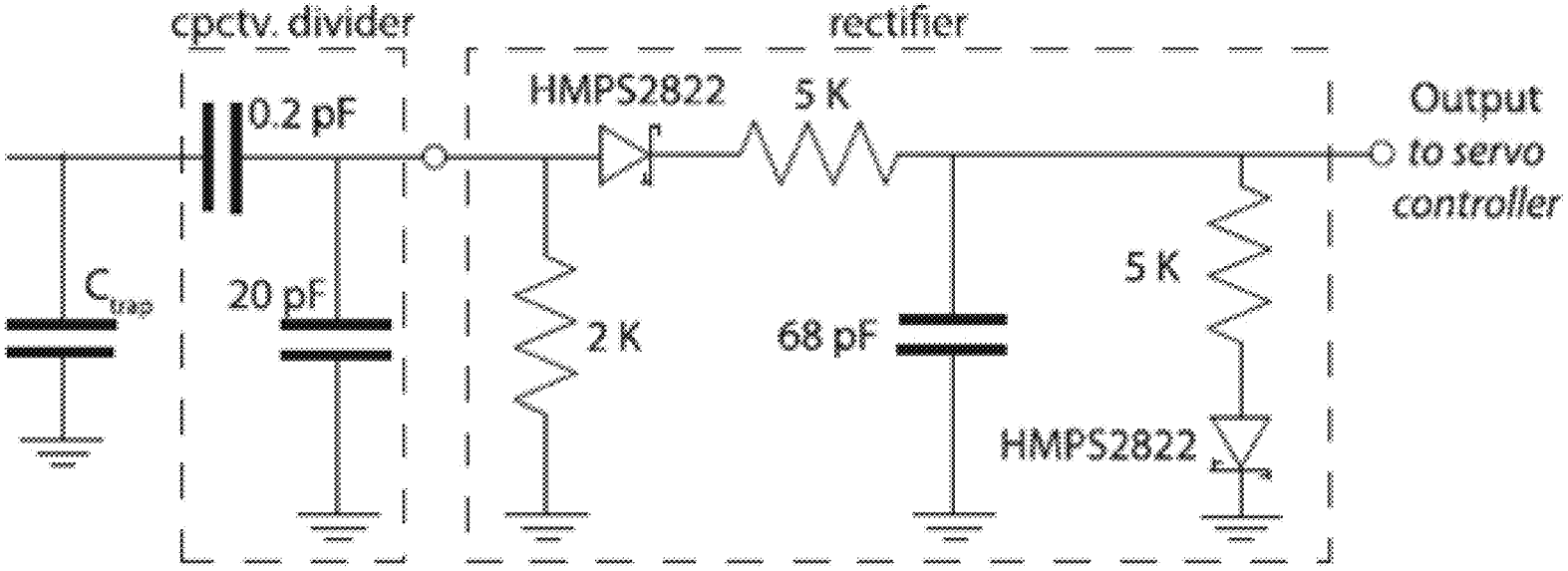
Figure 4B:
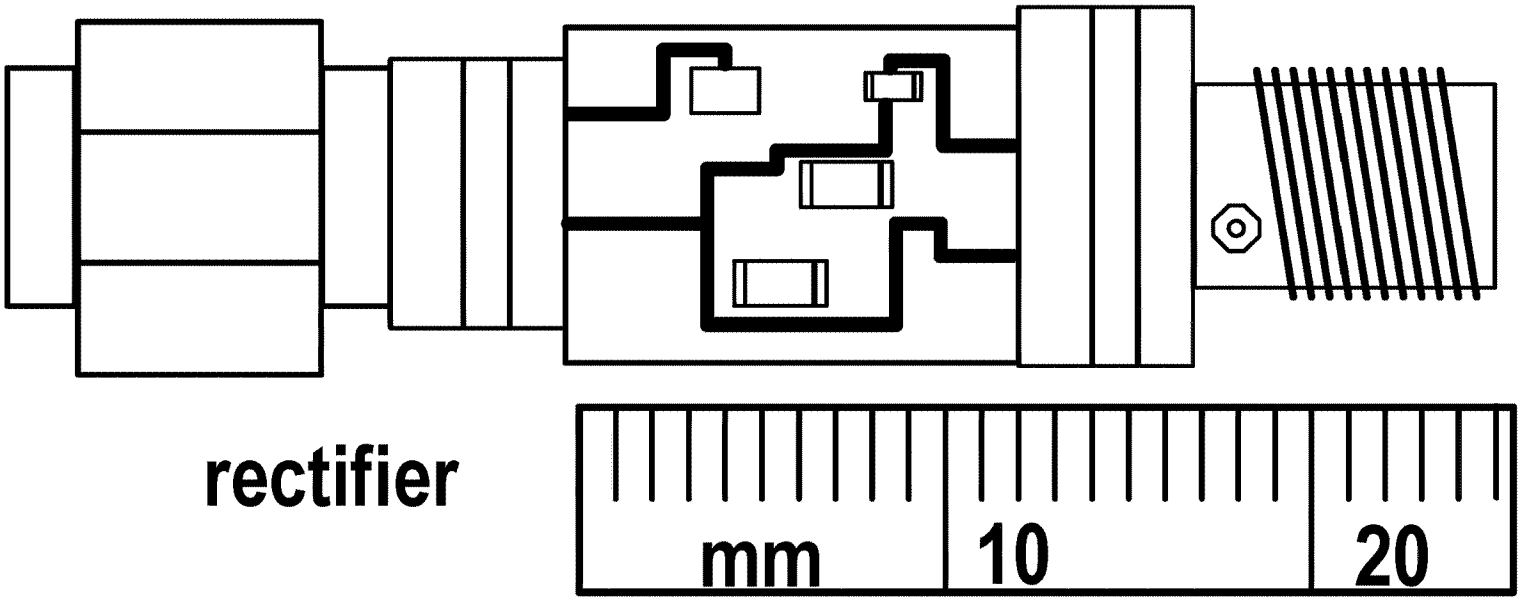

Turning now to FIG. 4(A)—which shows a schematic circuit diagram illustrating components of pick-off voltage divider and temperature compensating rectifier—it may be observed that a sampled signal passes through a rectifier circuit including two matched Schottky diodes (Avago HMPS-2822 MiniPak) configured for passive temperature compensation and a low-pass filter producing a ripple amplitude 10 dB below the diode input signal amplitude. High quality foil resistors and ceramic capacitors are used to reduce the effect of temperature drifts. The entire rectifying circuit is mounted inside a brass housing (Crystek Corporation SMA-KIT-1.5 MF) as shown in FIG. 4(B). The sampling circuit has a bandwidth of: 500 kHz, limited by the 5 kΩ/68 pF RC filter. The ratio of dc output voltage to RF input voltage amplitude, including the capacitive divider, is 1:250 at a drive frequency of 17 MHz, 1:330 at 100 MHz, and 1:870 at a drive frequency of 1 MHz.

The dc rectified signal is compared to a stable set-point voltage (Linear Technology LTC6655 5V reference mounted on a DC2095A-C evaluation board) with variable control (Analog Devices EVAL-AD5791 and ADSP-BF527 interface board), providing 20-bit set-point precision and ±0.25 ppm stability. The difference between these inputs—the error signal—is then amplified with proportional and integral gain (New Focus LB1005 servo controller) and fed back to regulate the upstream RF oscillator amplitude via the frequency mixer described above.

At this point we note that while method(s) and system(s) disclosed herein have employed analog sampling/feedback/servo control methodologies, the present disclosure is not so limited. More particularly, it is understood and should be appreciated by those skilled in the art that through the use of analog/digital-digital/analog components and circuits the sampling/feedback/servo control methodologies may be effected under computer control. In this inventive manner, the overall system may be more finely tuned and even reprogrammable for different operating conditions and/or applications—as desired and/or necessary.

Figure 5:
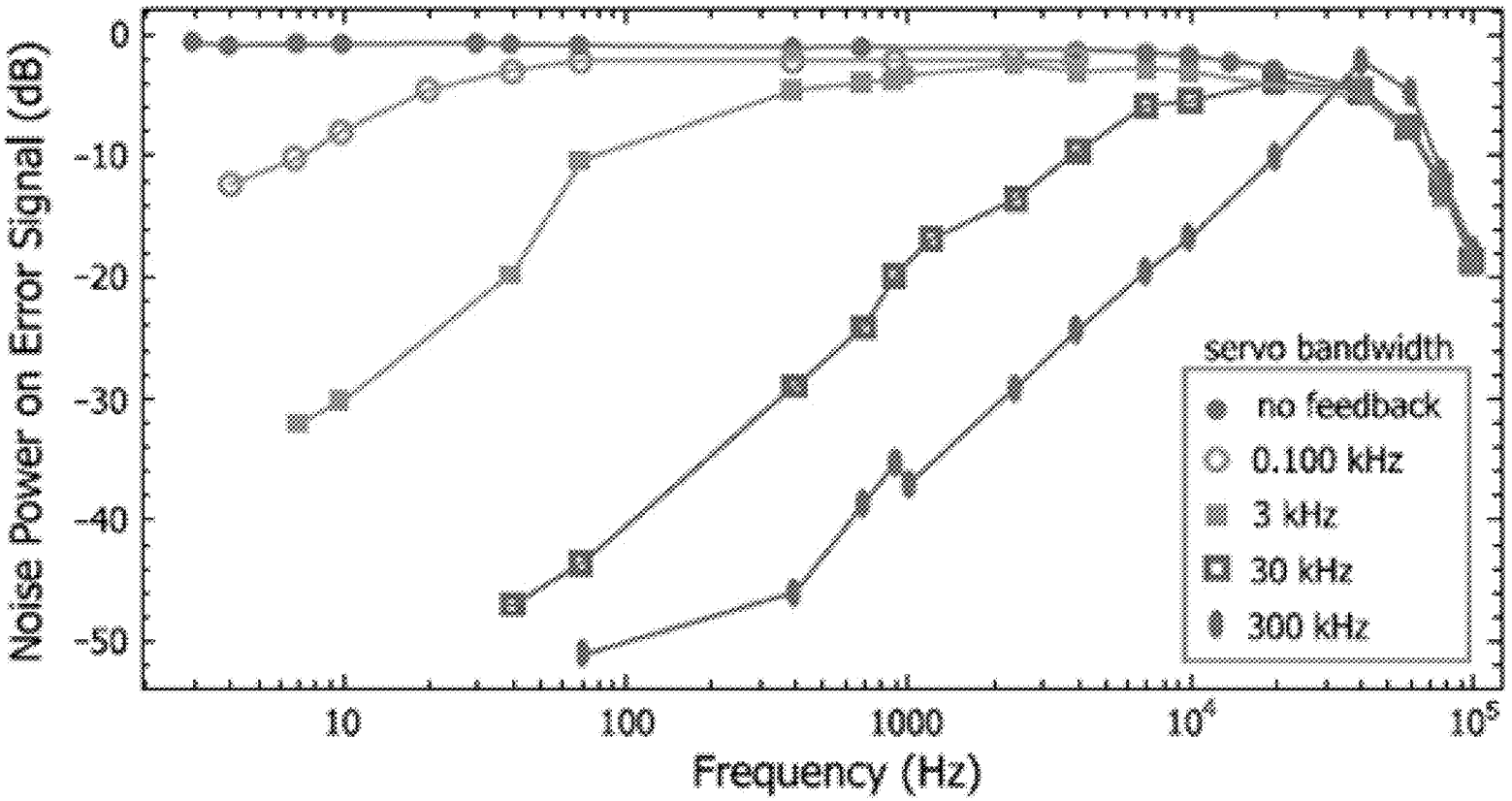
FIG. 5 shows a plot illustrating suppression of injected noise in the stabilization circuit for various levels of feedback according to aspects of the present disclosure.

FIG. 5 is a plot showing the response of the system for various servo controller gain settings when signals over a range of frequencies are injected into the system at the amplifier input. The RF drive is weakly amplitude-modulated at frequencies swept from 4 Hz to 100 kHz via a variable attenuator inserted before the RF amplifier. The amplitude of the resulting ripple on the error signal is measured as a function of the servo controller bandwidth. The overall frequency response of the feedback loop is limited to a bandwidth of 30 kHz, consistent with the linewidth $\Omega/(2\pi Q_U)$ of the helical resonator transformer.

We may now characterize the RF amplitude stabilization system by directly measuring the transverse motional oscillation frequency of a single atomic $^{171}Yb^+$ ion confined in the RF trap. We perform optical Raman sideband spectroscopy on the $F=0, m_f=0 \equiv \downarrow$ and $F=1, m_f=0 \equiv \uparrow$ "clock" hyperfine levels of the $^2S_{1/2}$ electronic ground state of $^{171}Yb^+$. This atomic transition has a frequency splitting of $\omega_0/2\pi=12.642815$ GHz and acquires frequency-modulated sidebands at $\omega_0 \pm \omega$ due to the harmonic motion of the ion in the trap, with $\omega/2\pi$:1 MHz. Before each measurement, the ion is Doppler cooled on the $^2S_{1/2}$ to $^2P_{1/2}$ electronic transition at a wavelength of 369.5 nm. The ion is next prepared in the ↓ state through optical pumping, and following a sideband spectroscopy process described below, the state (↓ or ↑) is measured with state-dependent fluorescence techniques.

The oscillation frequency is determined by performing Ramsey spectroscopy on the upper vibrational sideband of the clock transition at frequency $\omega_0+\omega$. Because the atomic clock frequency $\omega_0$ is stable and accurate down to a level better than 1 Hz, drifts and noise on the sideband frequency are dominated by the oscillation frequency ω. The sideband is driven by a stimulated Raman process from two counter-propagating laser light fields having a beatnote $\omega_L$ tuned near the upper vibrational sideband frequency. Following the usual Ramsey interferometric procedure, two π/2 pulses separated by time τ=0.4 ms drive the Raman transition. After the pulses are applied, the probability of finding the ion in the ↑ state $P(\delta)=(1+C\cos\tau\delta)/2$ is sampled, where $\delta=\omega_L-(\omega_0+\omega)$ is the detuning of the beatnote from the sideband and C is the contrast of the Ramsey fringes. The Ramsey experiment is repeated 150 times for each value of δ in order to observe the Ramsey fringe pattern P(δ) and track the value of ω. Because this Raman transition involves a change in the motional quantum state of the ion, the Ramsey fringe contrast depends on the purity and coherence of atomic motion. For short Ramsey times, the measured contrast of: 0.8 is limited by the initial thermal distribution of motional quantum states, and for Ramsey times τ>0.5 ms, the fringe contrast degrades further (FIG. 5), which is consistent with a decoherence timescale $(2\bar{n}_0\dot{\bar{n}})^{-1}$ for initial thermal state $\bar{n}_0=15$ quanta and motional heating rate $\dot{\bar{n}}=100$ quanta/s [18].

Figure 6:
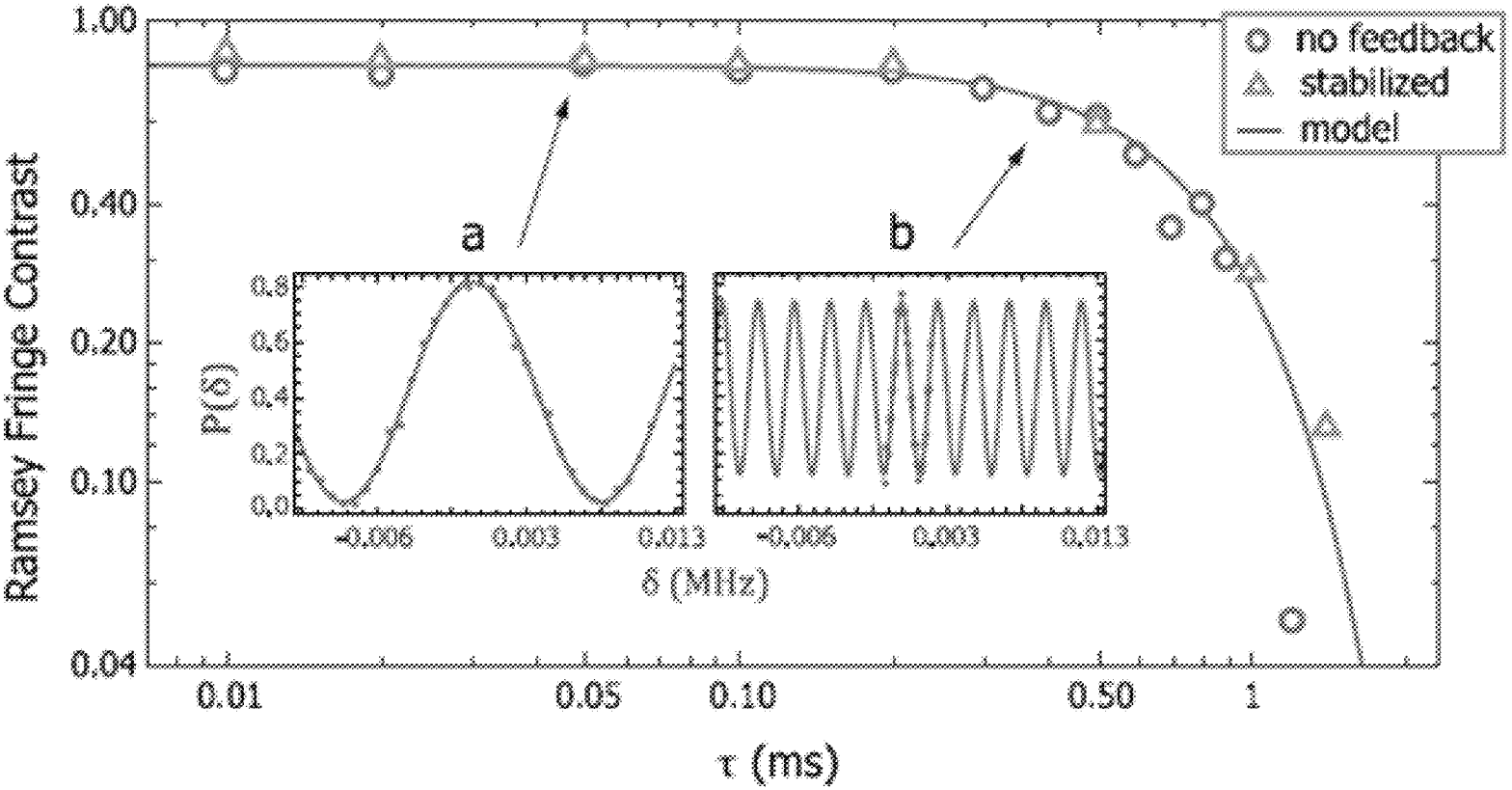
FIG. 6 shows a plot illustrating Ramsey fringe contrast as a function of the Ramsey time $\tau$ between $\pi/2$ pulses, with and without feedback according to aspects of the present disclosure.

Through Ramsey spectroscopy, we sample the ion trap oscillation frequency ω at a rate of 2.1 Hz for 80 minutes with no feedback on the RF potential, and then for another 80 minutes while actively stabilizing the RF potential. A typical time record of the the measurements over these 160 minutes is shown in FIG. 6 which shows Ramsey fringe contrast as a function of the Ramsey time τ between π/2 pulses, with and without feedback. The gray line is a model in which motional heating causes Ramsey fringe decoherence in: 0.5 ms. Inlays a and b show full Ramsey fringe measurements and fits for two different values of τ. As may be readily appreciated, feedback control clearly improves the stability of the ion oscillation frequency, and we observe a >30 dB suppression of drifts over long times.

Figure 7:
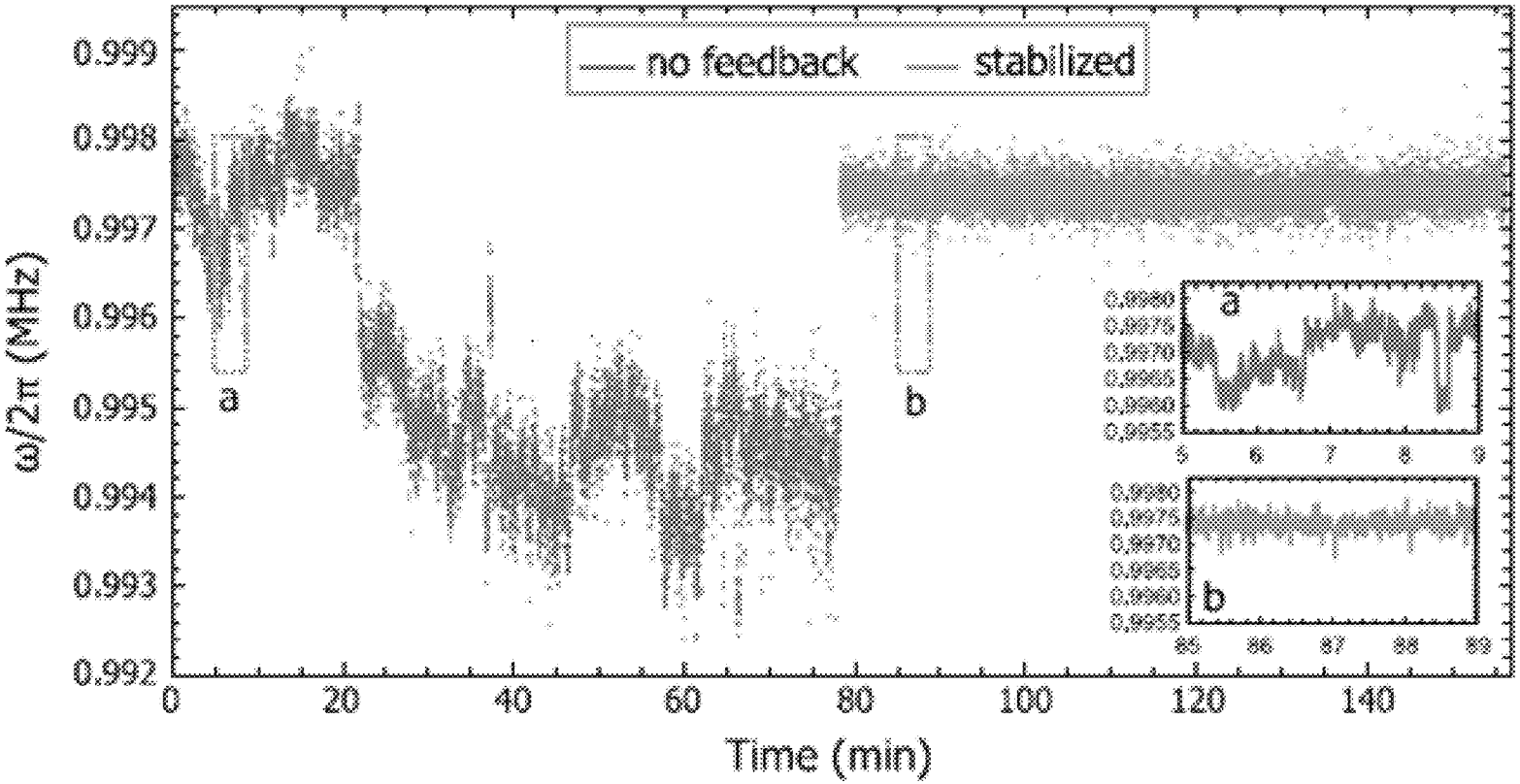
FIG. 7 shows a plot illustrating time dependence of ion harmonic oscillation frequency $\omega$ plotted over the course of 160 minutes with and without active stabilization according to aspects of the present disclosure.

From these measurements, we plot the Allan deviation of the ion harmonic oscillation frequency ω in FIG. 7 as a function of integration time T over the course of 160 minutes with and without active stabilization. Inlays a and b show magnified sections of the plot covering 4 min of integration. With feedback, there is a clear reduction in noise and drifts. Accordingly, when the system is stabilized, the Allan deviation in ω is nearly shot-noise limited (decreasing as $1/\sqrt{T}$) up to: 200 s of integration time, with a minimum uncertainty of better than 10 Hz, or 10 ppm, representing a 34 dB suppression of ambient noise and drifts. Without feedback, the trap frequency deviation drifts upward with integration time. For integration times shorter than 7 s, there is not sufficient signal/noise in the measurements to see the effects of feedback stabilization. However, as shown in FIG. 4, the lock is able to respond to error signals up to a bandwidth of: 30 kHz, and we expect significant suppression of noise at these higher frequencies as well. Although the Allan deviation of the oscillation frequency in the stabilized system improves with longer averaging time as expected, it drifts upward for a period just after T=50 s (likely caused by a temperature drift affecting the capacitive divider pick-off). We confirm this drift appears in the ion oscillation frequency ω and no t the driving field $\omega_L$ or the ion hyperfine splitting $\omega_0$ by performing the same experiment on the clock "carrier" transition near beatnote frequency $\omega_L=\omega_0$ instead of the upper sideband $\omega_L=\omega_0+\omega$.

Figure 8:
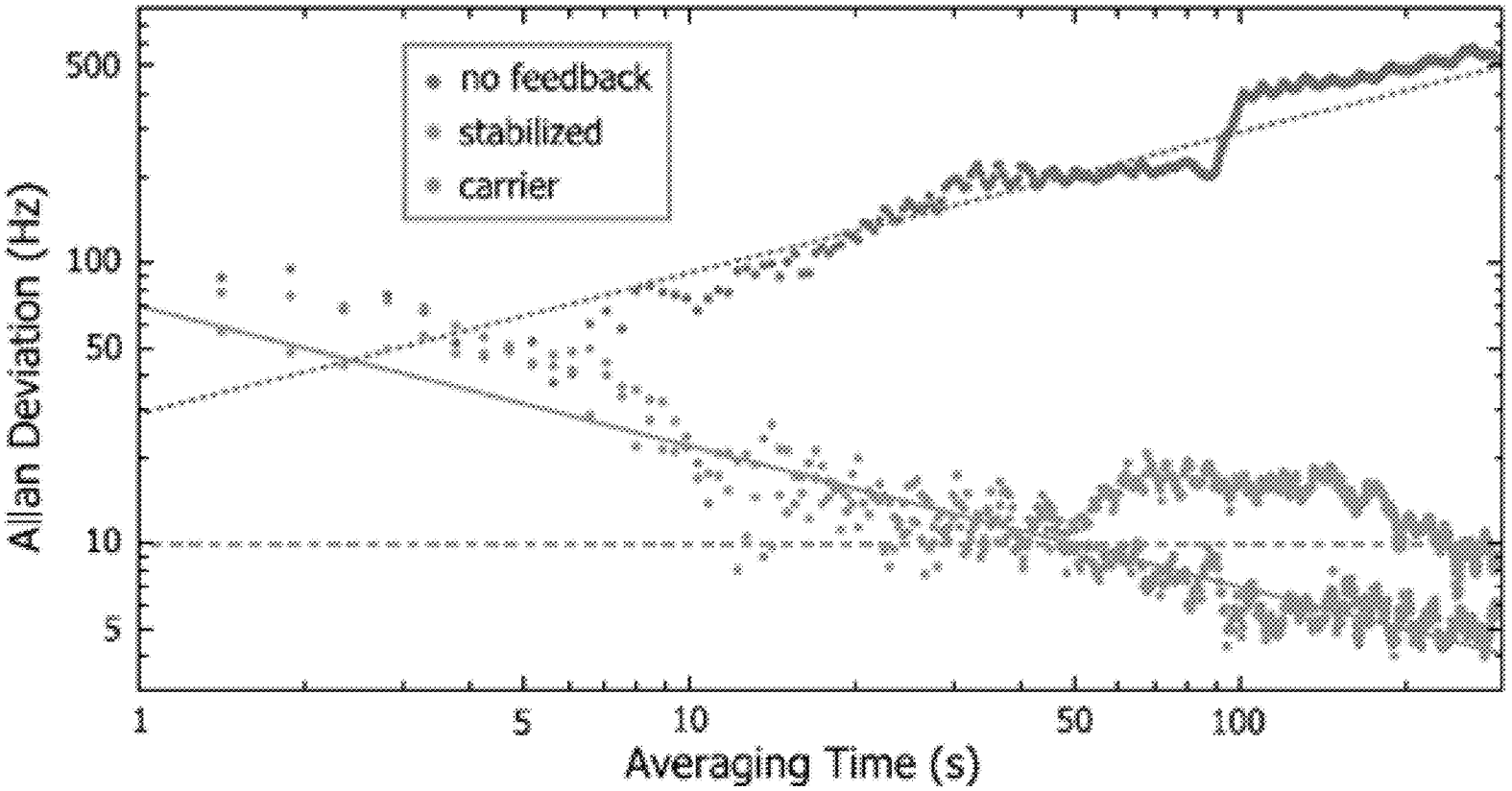
FIG. 8 shows a plot illustrating Allan deviation data of the secular frequency $\omega$ while the system is with and without feedback, as well as the Allan deviation of the qubit carrier transition according to aspects of the present disclosure in which the Allan deviation curves are calculated from the time record shown in FIG. 6, along with a similar measurement performed on the carrier transition.

FIG. 8 shown Allan deviation data of the secular frequency w while the system is with and without feedback, as well as the Allan deviation of the qubit carrier transition. The Allan deviation curves are calculated from the time record shown in FIG. 6, along with a similar measurement performed on the carrier transition.

As shown in FIG. 8, the measured Allan deviation of the carrier continues downward beyond T=50 s, meaning that the ion oscillation frequency is indeed the limiting factor at long times.

It should be possible to stabilize the RF trap frequency much better than the observed 10 ppm by improving passive drifts outside of feedback control. Such improvements may include the capacitive divider that samples the RF, the rectifier, the stable voltage reference, RF source frequency, and certain cables in the RF circuitry. As will be understood and appreciated by those skilled in the art, a number of these components will exhibit residual drifts with variations in temperature, mechanical strains, or other uncontrolled noise. With this in mind, we present below is a table of crucial components outside of feedback control and their estimated contribution to the instability.

TABLE 1

Table of crucial components outside of feedback control and estimated contribution to instability.

| Component | Stability |
|---|---|
| Capacitive Divider | 0 ≤ 60 ppm |
| Rectifier | 0.1 ppm |
| Voltage Reference | 0.25 ppm |
| RF source freq. | 0.1 ppb |
| Cables | Unknown |

As will be understood, the capacitive divider pick-off employed according to the present disclosure includes two capacitors each exhibiting a temperature coefficient of substantially ±30 ppm/° C. Given the voltage divider configuration, the net temperature coefficient can range from: 0-60 ppm/° C. depending on how closely the capacitors are matched. Because temperature drifts on the order of: 0.1° C. are expected without active temperature stabilization, the capacitive divider may limit stability of the system. Instabilities in the rectifier can arise from variability in the junction resistance of the diodes. In series with a 5 kΩ resistor, the: 0.01Ω/° C. junction resistance gives a net temperature coefficient of about 0.2 ppm/° C. in the rectifier response. This is roughly equal to the temperature coefficient of the resistors used in the rectifier circuit. By using the circuit configured for passive temperature compensation shown in FIG. 4, we estimate the net temperature coefficient of the rectifier response is reduced to: 0.1 ppm/° C.

Performance of the circuit is also improved by passively stabilizing components within the feedback loop as much as possible, such as temperature regulating the RF amplifier which feeds the resonator and using a passive mixer instead of a powered voltage variable attenuator. Notably, the helical transformer is particularly sensitive to temperature fluctuations and mechanical vibrations, which in turn alters the resonance frequency and quality factor. (Note that ensuring the helical coil is sealed against air currents can be more important than correcting small drifts in ambient temperature.) If the resonant frequency of the transformer drifts too far, then a feedback circuit with a fixed frequency source (as used here and shown in FIG. 2(B)) will call for more input power, and the servo system could possibly run away thereby becoming unstable. However, the resulting impedance mismatch from the off-resonant coupling will cause the servo to maintain the same amount of dissipated power in the resonator and not necessarily affect further drifts. In any case, we do not observe such servo runaway. This is true even when the set point is ramped down and back up to cycle the trap RF voltage during instances in which ions are too hot for effective laser cooling in the tighter trapping potential. The resulting transient thermal response has no apparent effect on the secular frequency stability.

Figure 9:
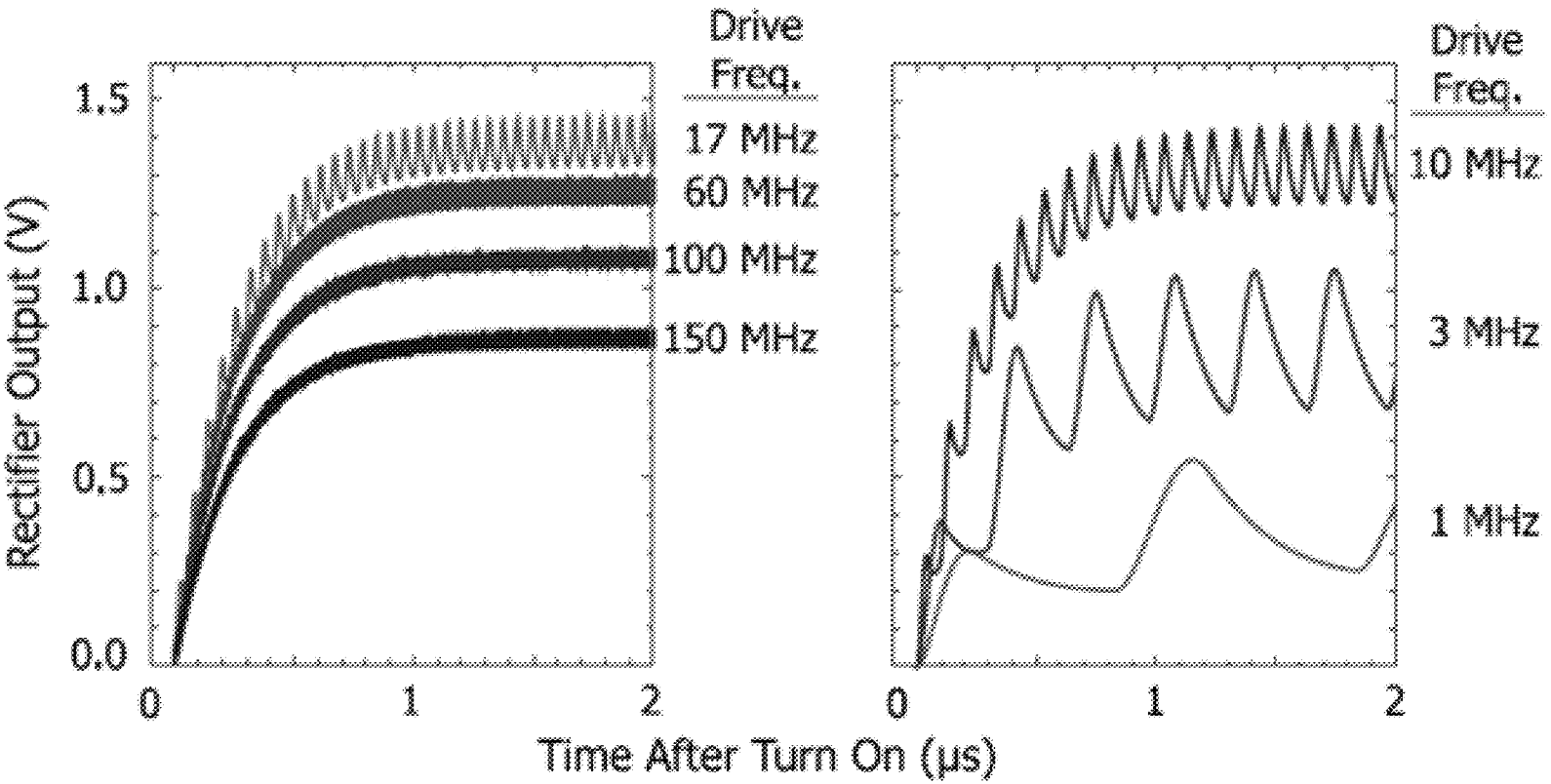
FIG. 9 shows a plot illustrating simulations of transient voltage output (into a 1MΩ load) of a rectifier circuit with a 700 Vpp RF trap drive turned on at t=0 s according to aspects of the present disclosure wherein the plot shows a response time, ripple, and dc offset at steady state for a range.

Based on simulations, this system is capable of stabilizing the RF amplitude in ion trapping apparatuses using a range of RF drive frequencies. With reference now to FIG. 9, which shows plots of simulations of the transient voltage output (into a 1MΩ load) of the rectifier circuit with a 700 Vpp RF trap drive turned on at t=0 s. The plots show a response time, ripple and dc offset at steady state for a range of drive frequencies.

As may be observed, FIG. 9 shows the transient turn-on and steady state responses of the rectifier output for drive frequencies ranging from 1 MHz to 150 MHz. We see that while 17 MHz gives near optimum steady state offset voltage, increasing or decreasing the drive frequency by up to an order of magnitude still provides an appreciable offset voltage (the optimum frequency can also be shifted by modifying the rectifier circuit). So long as the rectifier output offset voltage (ripple is filtered by the servo controller) is appreciable, the feedback loop will maintain performance near the demonstrated fractional secular frequency stability of better than 10 ppm, independent of ion mass (see Eq. 1).

If the temperature coefficients of the capacitors in the capacitive divider are properly matched and the divider is actively temperature-stabilized, we believe the technique presented herein may provide a minimum uncertainty in radial secular frequency of: 0.3 ppm. This uncertainty could likely be pushed even lower by further stabilization the voltage reference in addition to improved design of the whole apparatus including mechanical and thermal stabilization, improved electrical shielding, and shortened distances between components.

Figure 10:
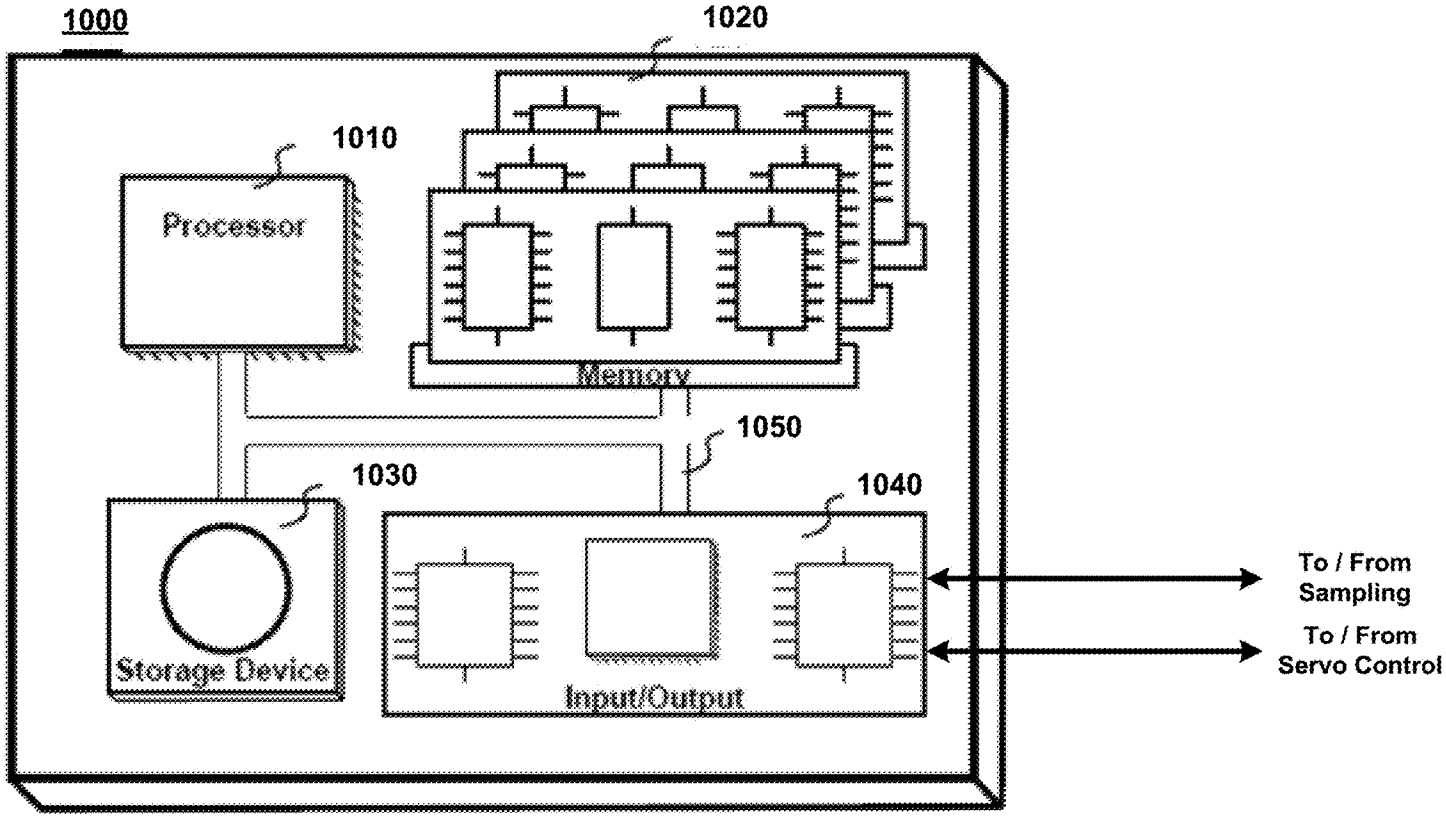
FIG. 10 shows a schematic depicting an illustrative computer system that may be employed to operate methods/systems according to the present disclosure under computer control.

Finally, FIG. 10 shows an illustrative computer system 1000 suitable for implementing methods and incorporation into systems according to an aspect of the present disclosure. As may be immediately appreciated, such a computer system may be integrated into another system may be implemented via discrete elements or one or more integrated components. The computer system may comprise, for example a computer running any of a number of operating systems. The above-described methods of the present disclosure may be implemented on the computer system 1000 as stored program control instructions.

Computer system 1000 includes processor 1010, memory 1020, storage device 1030, and input/output structure 1040. One or more input/output devices may include a display 1045. One or more busses 1050 typically interconnect the components, 1010, 1020, 1030, and 1040. Processor 1010 may be a single or multi core. Additionally, the system may include accelerators etc. further comprising the system on a chip.

Processor 1010 executes instructions in which embodiments of the present disclosure may comprise steps described in one or more of the Drawing figures. Such instructions may be stored in memory 1020 or storage device 1030. Data and/or information may be received and output using one or more input/output devices.

Memory 1020 may store data and may be a computer-readable medium, such as volatile or non-volatile memory. Storage device 1030 may provide storage for system 1000 including for example, the previously described methods. In various aspects, storage device 1030 may be a flash memory device, a disk drive, an optical disk device, or a tape device employing magnetic, optical, or other recording technologies.

Input/output structures 1040 may provide input/output operations for system 2000 including those operations to/from sampling circuitry and systems and those operations to/from servo control systems for use and control of ion trap systems according to the present disclosure.

At this point, those skilled in the art will readily appreciate that while the methods, techniques and structures according to the present disclosure have been described with respect to particular implementations and/or embodiments, those skilled in the art will recognize that the disclosure is not so limited. Accordingly, the scope of the disclosure should only be limited by the claims appended hereto.

The invention claimed is:

1. A method for actively stabilizing ion trap radiofrequency (RF) potentials comprising:

noninvasively sampling a high voltage potential at a position in a circuit between a step-up transformer and a vacuum feedthrough for electrodes of the ion trap;

rectifying the sampled high voltage potential signal; and applying the rectified signal to a feedback loop of the circuit such that an amplitude of an RF input to the circuit is desirably regulated, and the ion trap RF potentials are actively stabilized;

wherein the rectification is performed through the effect of a temperature compensating rectifier including two matched diodes configured for passive temperature compensation in conjunction with a low-pass filter configured such that a ripple amplitude of at least 10 dB below diode input signal amplitude is produced.

2. The method according to claim 1 further comprising:

applying the rectified signal to a frequency mixer that controls an RF oscillator amplitude.

3. The method according to claim 2 further comprising:

generating an error signal by comparing the rectified signal to a stable set-point voltage reference.

4. The method according to claim 3 further comprising:

amplifying the error signal and then applying the error signal to the frequency mixer.

5. The method according to claim 4 further comprising stabilizing a ratio of voltage to frequency ($V_0/\Omega$) through the effect of a digital counter and divider circuit.

6. The method according to claim 5 wherein the ion trap is a component of a system selected from the group consisting of: quantum information processor, ion trap mass spectrometer, and multipole mass spectrometer.

7. The method according to claim 6 wherein the ion trap exhibits a geometry selected from the group consisting of: quadrupole trap, linear trap, surface ion trap, hexapole trap, and higher-order trap.

8. The method according to claim 7 wherein the sampling and providing are effected under the control of a digital computer.

* * * * *